US007841390B1

(12) United States Patent
Kaser et al.

(10) Patent No.: US 7,841,390 B1
(45) Date of Patent: Nov. 30, 2010

(54) HEAT EXCHANGER HAVING POWDER COATED ELEMENTS

(75) Inventors: Jack Kaser, Homeland, CA (US); Deborah Kaser, Homeland, CA (US)

(73) Assignee: Paragon Airheater Technologies, Inc., Corona, CA (US)

( * ) Notice: Subject to any disclaimer, the term of this patent is extended or adjusted under 35 U.S.C. 154(b) by 0 days.

(21) Appl. No.: 10/793,182

(22) Filed: Mar. 3, 2004

Related U.S. Application Data

(60) Provisional application No. 60/452,065, filed on Mar. 3, 2003.

(51) Int. Cl.
*F28F 13/18* (2006.01)
*F28F 19/00* (2006.01)

(52) U.S. Cl. ..... 165/133; 165/134.1; 165/4

(58) Field of Classification Search ..... 165/4, 165/6, 8, 9, 10, 133, 134.1; 96/125; 106/14.05, 106/14.14
See application file for complete search history.

(56) References Cited

U.S. PATENT DOCUMENTS

| | | | | | |
|---|---|---|---|---|---|
| 1,762,446 | A | * | 6/1930 | Ljungstrom | 165/8 |
| 2,731,432 | A | * | 1/1956 | Toulmin, Jr. | 524/442 |
| 2,974,051 | A | * | 3/1961 | Moore | 501/19 |
| 3,142,583 | A | * | 7/1964 | McMahon et al. | 428/560 |
| 3,372,038 | A | * | 3/1968 | Weldes et al. | 106/1.17 |
| 3,389,002 | A | * | 6/1968 | Huffcut | 106/626 |
| 3,513,012 | A | * | 5/1970 | Point | 427/470 |
| 3,910,344 | A | * | 10/1975 | Hagen | 165/10 |
| 3,974,360 | A | | 8/1976 | Panzarino | |
| 3,978,316 | A | | 8/1976 | Rose et al. | |
| 4,015,048 | A | | 3/1977 | Martin | |
| 4,093,435 | A | * | 6/1978 | Marron et al. | 96/125 |
| 4,200,441 | A | * | 4/1980 | Honmann et al. | 96/125 |
| 4,281,451 | A | | 8/1981 | Mann | |
| 4,421,789 | A | * | 12/1983 | Kaneko et al. | 427/204 |
| 4,542,782 | A | * | 9/1985 | Berner | 165/9 |
| 4,552,204 | A | | 11/1985 | Bellows | |

(Continued)

FOREIGN PATENT DOCUMENTS

BE 512 071 A 6/1952

(Continued)

OTHER PUBLICATIONS

"The VN air preheater", Technical description, Howden Sirocco, Heavy Machines Division.

(Continued)

*Primary Examiner*—Tho v Duong
(74) *Attorney, Agent, or Firm*—Knobbe Martens Olson & Bear, LLP

(57) ABSTRACT

Powder coated heat exchange elements for a heat exchanger. Powder coating provides improved protective coating on surfaces of heat exchange elements. In many applications, the heat exchange elements are subjected to harsh operating conditions that promote corrosion. Traditional enamel coating tends to fracture when subjected to mechanical stresses thereby allowing corrosion inducing agents to penetrate and corrode the underlying surfaces. Powder coating reduces breaches in the protective layer. Powder coating may be adapted to withstand high temperatures so as to make them suitable for use in harsh operating environments. One such environment can be found in the processing of flue gas from fossil burning power generators, where the flue gas has a relatively high temperature and high sulfur content.

41 Claims, 10 Drawing Sheets

U.S. PATENT DOCUMENTS

| | | | | | |
|---|---|---|---|---|---|
| 4,558,732 | A | | 12/1985 | Bellows | |
| 4,665,880 | A | | 5/1987 | McWade | |
| 4,698,415 | A | * | 10/1987 | Sinclair et al. | 528/388 |
| 4,733,056 | A | | 3/1988 | Kojima et al. | |
| 4,744,410 | A | * | 5/1988 | Groves | 165/10 |
| 4,838,342 | A | | 6/1989 | Goetschius | |
| 5,034,432 | A | | 7/1991 | Ueno et al. | |
| 5,185,297 | A | | 2/1993 | Park et al. | |
| 5,190,830 | A | | 3/1993 | Matsuo et al. | |
| 5,229,470 | A | * | 7/1993 | Nozaki et al. | 525/440.02 |
| 5,272,185 | A | * | 12/1993 | Matsumura et al. | 523/212 |
| 5,330,794 | A | * | 7/1994 | Bosco et al. | 427/387 |
| 5,407,741 | A | | 4/1995 | Ota | |
| 5,539,031 | A | | 7/1996 | van Ooij | |
| 5,635,548 | A | | 6/1997 | Kittle et al. | |
| 5,881,799 | A | | 3/1999 | Kozacka et al. | |
| 5,930,459 | A | | 7/1999 | Eckman et al. | |
| 5,950,707 | A | | 9/1999 | Kozacka et al. | |
| 6,013,898 | A | | 1/2000 | Mizuno et al. | |
| 6,077,483 | A | | 6/2000 | Locker et al. | |
| 6,106,630 | A | | 8/2000 | Frankel | |
| 6,130,410 | A | | 10/2000 | Kita | |
| 6,201,217 | B1 | | 3/2001 | Moon et al. | |
| 6,253,833 | B1 | * | 7/2001 | Koster et al. | 165/10 |
| 6,264,905 | B1 | | 7/2001 | Spokoyny | |
| 6,472,472 | B2 | * | 10/2002 | Jung et al. | 525/175 |
| 7,244,780 | B1 | * | 7/2007 | Robinson et al. | 524/441 |
| 2002/0078856 | A1 | * | 6/2002 | Hahn et al. | 106/14.14 |
| 2002/0169234 | A1 | | 11/2002 | Ring et al. | |
| 2003/0148026 | A1 | | 8/2003 | Mushett et al. | |
| 2003/0149193 | A1 | | 8/2003 | Rickert et al. | |

FOREIGN PATENT DOCUMENTS

| | | |
|---|---|---|
| WO | WO 94/29660 | 12/1994 |
| WO | WO 99/35458 | 7/1999 |

OTHER PUBLICATIONS

Search Report for PCT Application No. PCT/US2006/030337, mailed Nov. 24, 2006.

*SCR Compatability for the Ljungstrom® Air Preheater*, Louis P. Bondurant III, published 1999, 8 pages.

*SCR and SNCR Processes Increase the Risk of Air Preheater Fouling*, Lehigh Energy Update, vol. 19, Jun. 2001, 3 pages.

Non-final Office Action mailed on Oct. 8, 2009 in U.S. Appl. No. 11/198,406.

Claims as allowed on Jul. 27, 2010 in U.S. Appl. No. 11/198,406.

* cited by examiner

HEAT EXCHANGER HAVING POWDER COATED ELEMENTS

RELATED APPLICATIONS

This application claims the benefit of U.S. Provisional Application No. 60/452,065 entitled "Rotary Heat Exchanger with Powder Coated Heat Exchange Elements" filed Mar. 3, 2003, which is hereby incorporated by reference.

BACKGROUND

1. Field

The present teachings relate to heat exchangers and, in particular, relates to a heat exchanger having powder coated elements that inhibit corrosion.

2. Description of the Related Art

Heat exchangers in various forms are included in systems that control the condition of air. Conventional heat exchangers include a heater that takes input air and outputs air with a higher temperature. A cooler, generally referred to as an air conditioner, takes input air and outputs air with a lower temperature. In both cases, the change in temperature is achieved by some form of a heat exchanger. In a heater, air is typically blown past a heated element such that heat is transferred from the heated element to the air. In a cooler, air is typically blown past a chilled element such that heat is transferred from the air to the chilled element.

A rotary heat exchanger is an apparatus that exchanges heat with relatively large volumes of air. The rotary heat exchanger typically comprises a cylindrically shaped device that permits air to flow therethrough. Typically, heat exchange is achieved by flowing both the input air and exhaust air through the rotating rotary heat exchanger at two different locations. Heat exchange elements in the exchanger remove heat from one flow of air and release the heat to the other flow of air. The rotational speed can be selected to permit efficient overall heat transfer.

In operation, the heat exchangers are exposed to conditions that tend to induce corrosion of the metal of the heat exchange elements. To counter the corrosion problems, traditional heat exchange elements often have an enamel coating applied to the surface of the metal. Often, the enamel coating contains bubbles such that full corrosion protection is not afforded. In addition, the enamel coating is susceptible to cracking when subjected to mechanical stresses. Such breach of the coating allows corrosion inducing agents to come in contact with the metal, thereby causing corrosion, which in turn reduces the effectiveness of the heat exchanger.

From the foregoing, it will be appreciated that there is a need for an improved method of fabricating a heat exchanger. To this end, there also exists a need for an improved method of protecting the metal of the heat exchange elements so as to provide improved corrosion resistance.

SUMMARY

The aforementioned needs may be satisfied by a heat exchanger comprising, in one embodiment, a heat exchanging body that rotates in a first direction with respect to a housing and a plurality of heat exchange elements disposed in the heat exchanging body so as to define a plurality of channels that allow air to flow therethrough, wherein each heat exchange element includes a powder coating to thereby resist corrosion.

In one aspect, the heat exchanging body comprises a rotor. The rotor may be adapted to rotate about a rotational axis with respect to the housing such that a given portion of the rotor gains heat energy at a first location and gives off heat energy at a second location. In addition, the heat exchanger further comprises a first air passage assembly disposed adjacent the heat exchanging body, and wherein the air passage assembly is adapted to allow air to flow through a portion of the heat exchange body. Also, the first air passage assembly is disposed adjacent the rotor at one of the first or second locations. The air passage assembly is adapted to allow flow of air through a portion of the heat exchange body along a first direction relative to the rotational axis. The first direction is substantially parallel to the rotational axis. Moreover, the heat exchanging body is divided into a plurality of sectors, and wherein each sector includes at least one heat exchange element positioned therein.

In another aspect, the powder coating comprises a high silica content. The powder coating is applied to the heat exchange elements with a temperature cure of approximately 400-500° F., 400-450° F. in about 15 minutes, or 400° F. in about 60 minutes. Also, the powder coating is adapted to withstand approximately 1000° F. for approximately 24 hours. The thickness of the powder coating on the heat exchange elements is between approximately 1.5-2.5 mils, or the thickness is between approximately 2-4 mils. Moreover, the powder coating comprises a layer of fused powder applied to the heat exchange elements in an electrostatically charged powder form and cured by heat.

In still another aspect, the heat exchanger is adapted to be used in a high sulfur content air and high temperature environment. Also, the heat exchanger is adapted to be used to reduce the temperature of a flue gas being emitted from a fossil burning power generator prior to the gas being ejected into the environment.

The aforementioned needs may also be satisfied with a heat exchanger comprising, in one embodiment, a heat exchanging body that rotates with respect to a housing and a first air passage assembly disposed adjacent the heat exchanging body, wherein the air passage assembly is adapted to allow flow of air through a portion of the heat exchange body. In addition, the heat exchanger may further comprise a plurality of heat exchange elements disposed in the heat exchanging body, wherein each heat exchange element defines a heat exchanging surface adapted to facilitate the heat exchange with the air flowing through the heat exchanging body, and wherein the heat exchanging surface includes a powder coating that resists corrosion.

In one aspect, the heat exchanging body defines a plurality of segments, and wherein each segment defines a volume dimensioned to receive a plurality of heat exchange elements, and wherein each segment extends from a first angle to a second angle so as to generally resemble a pie-slice shape when viewed along the rotational axis. In addition, the heat exchange elements comprise shaped sheets of material dimensioned so as to be stackable along a radial direction, and wherein the shaped sheets are oriented so as to allow flow of air with a net direction that is generally parallel to the rotational axis. Also, the shaped sheets comprise a material selected from the group consisting of a sheet of metal, a sheet of stainless steel, a sheet of low carbon steel. The thickness of the shaped sheet is between approximately 18-24 gauge. Moreover, the shaped sheets define a plurality of channels for the flow of air such that, when stacked, the channels extend in a direction substantially parallel to the rotational axis. The shaped sheets comprises a first type of sheet and a second type of sheet such that the first type of sheet defines a plurality of channels that extend along a first direction relative to the rotational axis and the second type of sheet defines a plurality of channels that extend along a second direction relative to the rotational axis. The channels of the first type of sheet and the channels of the second type of sheet form crossing patterns.

The aforementioned needs may also be satisfied by a heat exchange assembly for a heat exchanger having a heat exchanging body that rotates in a first direction with respect to a housing. In one embodiment, the assembly comprises a plurality of heat exchange members that are formed so as define a heat exchange surface, wherein the heat exchange members are positioned in the heat exchanging body to thereby facilitate heat exchange with air. In addition, the assembly further comprises a protective layer disposed on the heat exchange surface, wherein the protective layer comprises a powder coating that inhibits corrosion of the heat exchange members.

In one aspect, the heat exchange members comprise a cross sectional shape including a plurality or undulations separated by a flat section, and wherein each undulated shape comprises an upper curved shape joined to a lower curved shape so as to form a full cycle wave like structure. In addition, the heat exchange members may comprise a corrugated configuration or a notched flat configuration. Moreover, the powder coating provides a barrier for the underlying heat exchange members to thereby resist corrosion inducing agents including water and sulfur based compounds.

The aforementioned needs may also be satisfied by a method of fabricating a heat exchanger having a plurality of heat exchange elements adapted to allow flow of air therethrough and exchange heat with the flowing air. In one embodiment, the method comprises preparing the heat exchange elements for assembly, powder coating the heat exchange elements, and assembling the heat exchange elements. In one aspect, powder coating the heat exchange elements comprises cleaning the surface of the heat exchange elements and electrically grounding the heat exchange elements. In addition, powder coating the heat exchange elements further comprises applying electrostatically charged coating particles onto the heat exchange elements wherein the electrostatically charged coating particles are attracted to the electrically ground heat exchange elements thereby promoting adhesion of the coating particles to the surfaces of the heat exchange elements and curing the heat exchange elements so as to cause the coating particles to fuse with the surfaces of the heat exchange elements.

The aforementioned needs may also be satisfied by a method of applying a corrosion resistant coating on a heat exchange element adapted for use in a heat exchanger. In one embodiment, the method comprises preparing the surface of the heat exchange element and electrically connecting the heat exchange element to a first potential. In addition, the method comprises applying electrostatically charged coating particles onto the heat exchange element wherein the first potential and the electrostatic charge of the coating particles are selected to promote adhesion of the coating particles to the surface of the heat exchange element and curing the heat exchange element so as to cause the coating particles to fuse with the surface of the heat exchange element. In one aspect, preparing the surface comprises cleaning the surface so as to facilitate adhesion of the coating particles. In addition, electrically connecting the heat exchange element comprises electrically grounding the heat exchange element.

These and other advantages of the present teachings will become more fully apparent from the following description taken in conjunction with the accompanying drawings.

DETAILED DESCRIPTION OF CERTAIN EMBODIMENTS

Reference will now be made to the drawings wherein like numerals refer to like parts throughout. FIGS. 1A-7 illustrate various aspects related to a heat exchanger having powder coated elements that inhibit corrosion. Various other aspects of the present teachings will be described in greater detail herein below with reference to the drawings. In general, it should be appreciated that the following description of a heat exchanger and elements comprised therein is in the context of a rotary heat exchanger. However, it should be appreciated by those skilled in the art that the novel features described herein are not limited to rotary type devices, but may be applied to various other types of generally known heat exchangers.

Figure 1A:
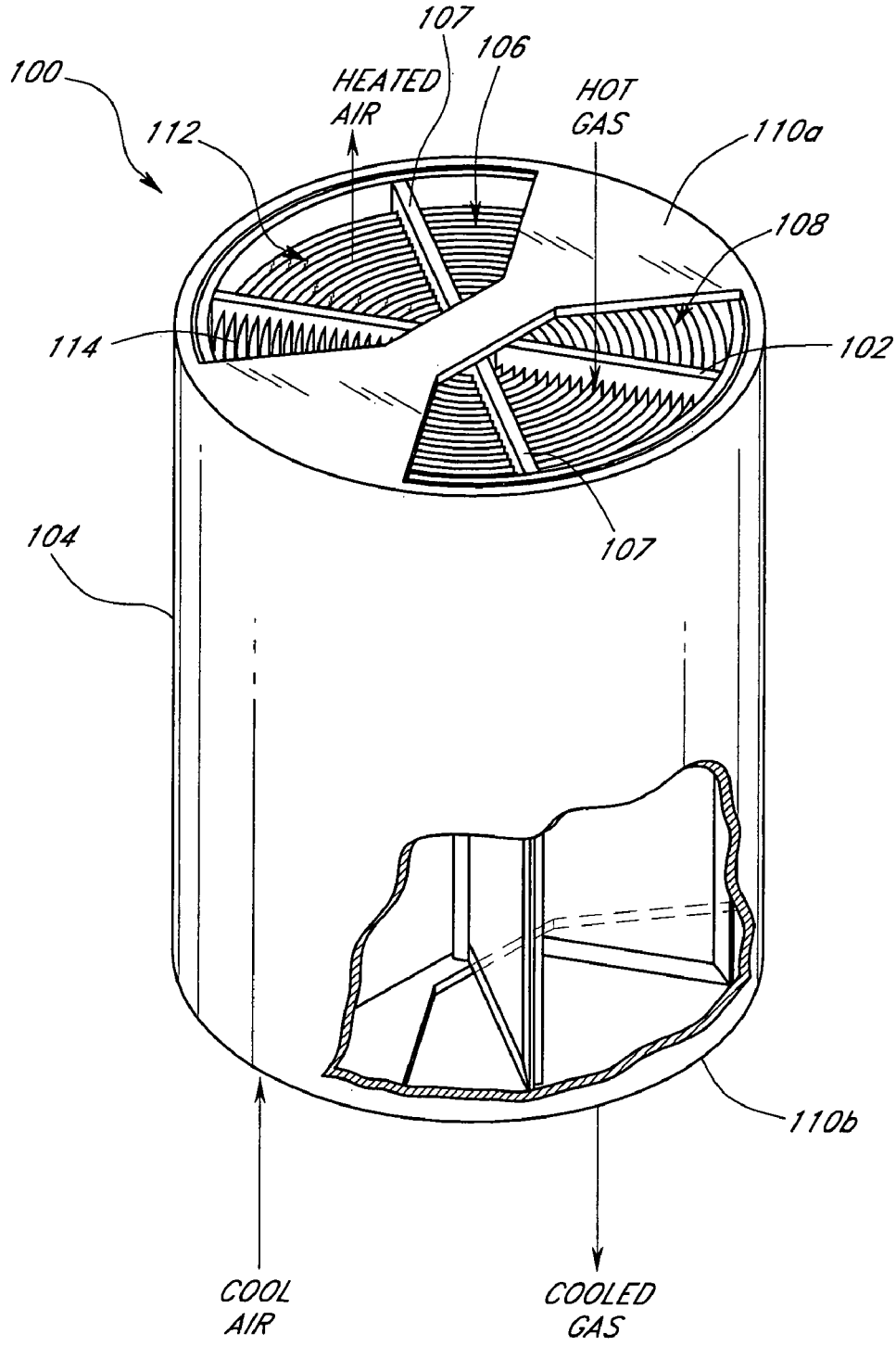
FIG. 1A illustrates a side view of an exemplary rotary heat exchanger.
Figure 1B:
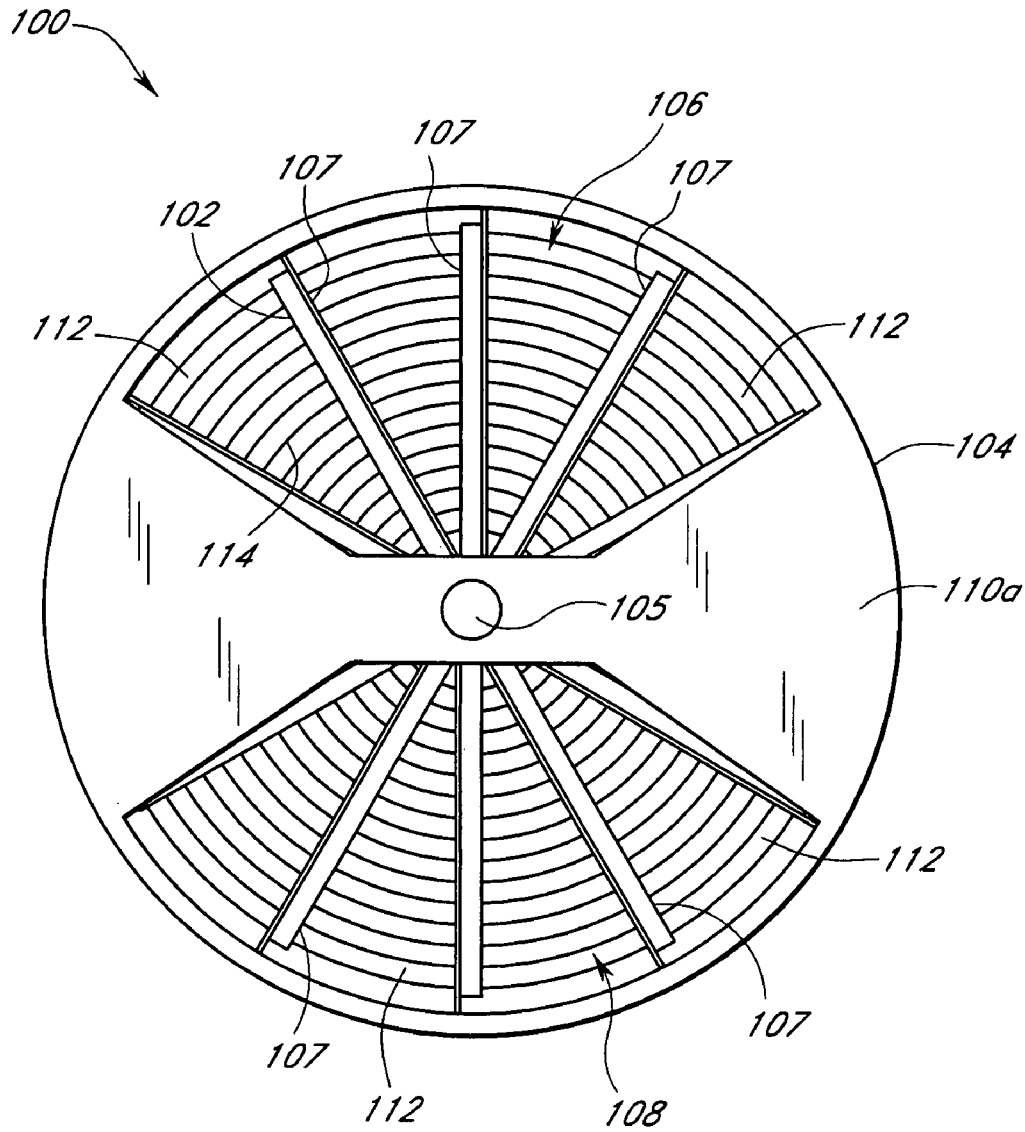
FIG. 1B illustrates an end view of an exemplary rotary heat exchanger.

FIG. 1A illustrates a perspective view of a regenerative heat exchanger 100 having one or more powder coated elements that inhibit corrosion. FIG. 1B illustrates a top view of the heat exchanger 100. As illustrated in FIGS. 1A-1B, the heat exchanger 100 comprises a heat exchanger body or rotor 102 that is positioned within a heat exchanger housing 104. In one embodiment, the heat exchanger 100 comprises a rotary heat exchanger, wherein the heat exchanger body 102 comprises a cylindrical rotor and the heat exchanger housing 104 comprises a cylindrical housing. Additionally, as further illustrated in FIGS. 1A-1B, the cylindrical rotor 102 is rotatably mounted within the cylindrical housing 104 via a center shaft 105 so as to be coaxial therewith. Also, the heat exchanger rotor 102 further comprises a plurality of radial walls 107 that extend radially outward from the center shaft 105.

In one embodiment, the heat exchanger housing 104 comprises first and second sector plates 110*a*, 110*b* that are respectively mounted to the first and second ends of the housing 104. The heat exchanger housing 104 is formed so as to define at least two conduit openings 106, 108 that form a portion of the intake or cold air conduit and the exhaust or hot gas conduit. Also, the sector plates 110*a*, 110*b* divide the intake conduit from the exhaust conduit and can be connected to duct work (not shown) in a generally known manner.

In one embodiment, the plurality of radial walls 107 divides the heat exchanger rotor 102 into a plurality of sectors 112 comprising core material 114. The core material 114 is adapted to absorb heat carried in the exhaust gas from the exhaust conduit and then transfer the absorbed heat to the intake air when the heated sector 112 is positioned in the path of the intake conduit. In one aspect, the core material 114 may comprise thin corrugated conductive material, such as metal, that allows exhaust gases to travel therethrough. Also, heat carried within the exhaust gases heats the core material 114 in the exhaust conduit.

Similarly, cool air passing through the core material 114 in the intake conduit is heated by the retained heat of the core material 114 during passage of the intake air through the core material 114. The heat exchanger 100 sequentially exposes each sector 112 to hot gas in the exhaust conduit so that the core material 114 is heated and, during rotation, exposes the heated sectors 112 of core material 114 to the intake conduit so that cooler air traveling through the intake conduit is heated by the core material 114. The heated air is then exhausted from the heat exchanger 100.

It should be appreciated that the above described heat exchanger 100 may operate in a similar manner to the operation of generally known Ljunstrom-type preheaters. It should also be appreciated from the following description that, while this particular embodiment of the perimeter seal assembly may be configured to be used with a Ljungstrom-type preheater, the perimeter seal assembly may be adapted by one skilled in the art to be used with a Rothmule-type preheater, where the rotor is stationary and the ductwork rotates with respect to the rotor, without departing from the scope of the present teachings.

Figure 2:
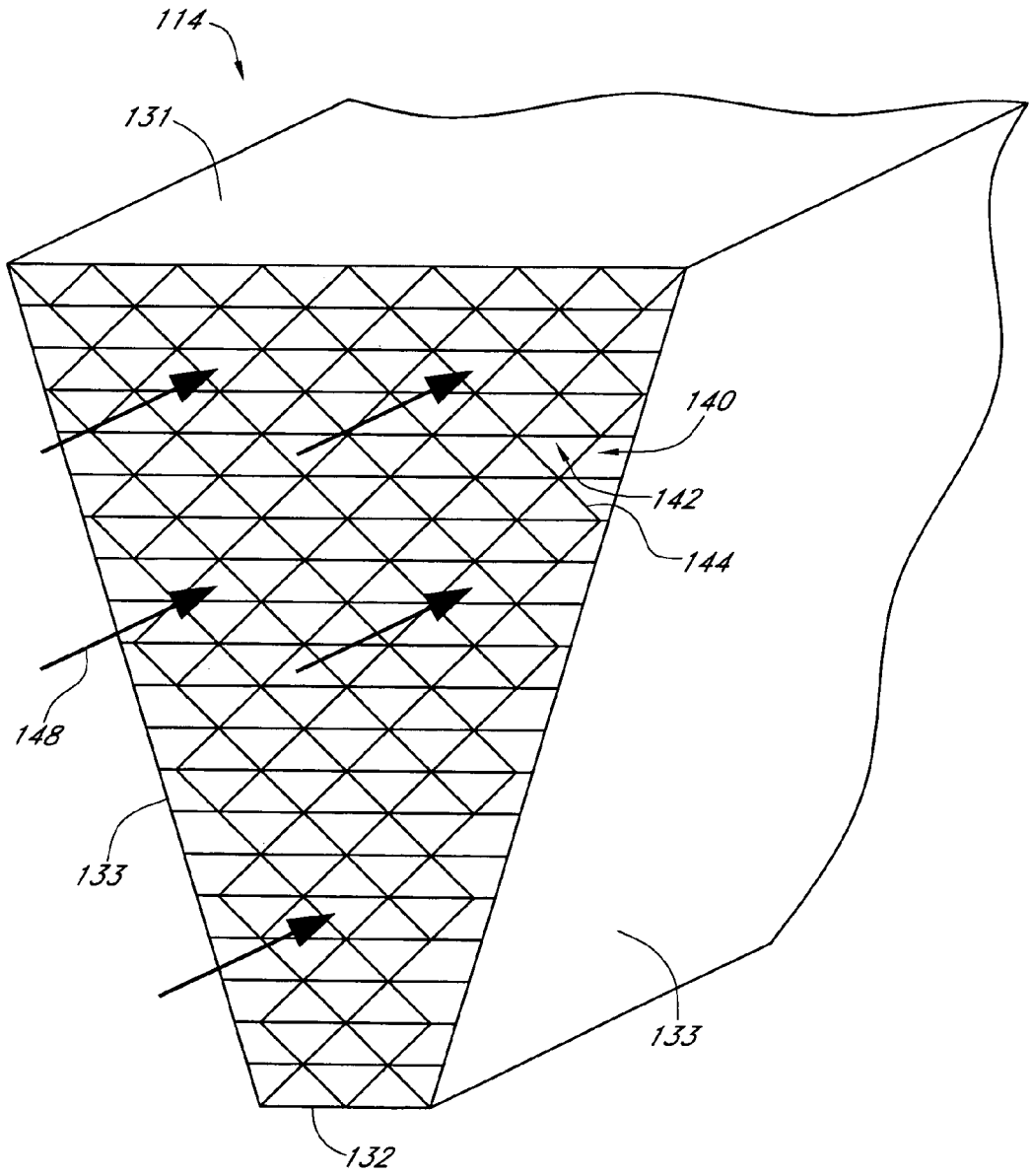
FIG. 2 illustrates a segment of a rotor of the rotary heat exchanger, wherein the segment comprises a plurality of heat exchange elements stacked within a defined volume.

FIG. 2 illustrates one embodiment of the core material 114 formed in the plurality of sectors 112 of the heat exchanger rotor 102. As illustrated in FIG. 2, the core material 114 may comprise a wedge shaped enclosure formed by a top plate 131, a bottom plate 132, and at least two side plates 133. The plates 131, 132, 133 may be adapted to define a cavity within which a plurality of heat exchange elements 140 are disposed. In one aspect, the heat exchange elements 140 define channels 142 that are stacked adjacently together so as to permit flow of air through the channels 142. Additionally, the channels 142 extend in a direction substantially parallel to the axis of rotation of the heat exchange rotor 102. Hence, the air flow 148 can be in a direction relative to the axis of rotation.

In the embodiment, the heat exchange elements 140 are formed with corrugated and flat material, such as corrugated and flat sheet metal, that are joined together in a manner so as to form triangular shaped channels 142. In addition, as illustrated in FIG. 2, the channels 142 are layered, stacked, or arranged within the segment 130 so as to fill the sector 112 of the heat exchange rotor 102. Advantageously, the arrangement of the layered elements 140 allow increased surface area between the flowing air and the surface of the channels 142.

Moreover, one aspect of the present teachings relates to the heat exchange elements 140 having a resilient surface 144 that inhibits corrosion during harsh operating conditions and environments. For example, in one embodiment, the resilient surface 144 of the heat exchange elements 140 comprises a powder coating applied thereto so as to define a power coated surface. Advantageously, the coated heat exchange elements 140 provide an improved resilience and reliability to thereby increase corrosion resistance more so than a typical traditional enamel coating.

In one embodiment, the powder coating of the resilient surface 144 comprises a high silica content. Examples of the powder coating material is manufactured by TCI Powder Coatings located in Ellaville, Ga. and Alesta Powder Coatings located in Houston, Tex. In addition, the powder coating of the resilient surface 144 is formed with a low temperature cure of approximately 400-500° F. Under some circumstances, the curing process is achieved with a temperature of approximately 400-450° F. in about 15 minutes. In other circumstances, the curing process is achieved with a temperature of approximately 400° F. in about 60 minutes, such as with metal materials. Advantageously, the power coating of the resilient surface 144 of the heat exchange elements 140 is suitable for the harsh operating conditions of the heat exchanger 100. For example, in one aspect, the powder coating material can withstand 1000° F. for approximately 24 hours. Additionally, in one embodiment, the film thickness of the powder coating on the heat exchange elements 140 is between approximately 1.5-2.5 mils. In various other embodiments, the film thickness of the powder coating on the heat exchange elements 140 is between approximately 2-4 mils.

Conversely, conventional enameling of the resilient surface 144, as in the prior art processes, requires an extremely high curing temperature of at least 1500° F. Unfortunately, this extremely high temperature can warp or deform the heat exchange elements 140, which can adversely impact the efficiency and reliability of the heat exchanger 100.

Furthermore, this extremely high curing temperature of the prior art can oxidize and corrode the surface of the heat exchange elements 140. Also, in some circumstances, enamel is brittle and can fracture under the harsh operating conditions and stresses of the heat exchanger 100. For example, in general, coal exhaust can contain sulfur compounds. If the heat exchanger is used with coal exhaust, sulfur can combine with condensation so as to produce sulfuric acid. As a result, the sulfuric acid can corrode metal surfaces that are exposed when the enamel surface fractures or chips off. Sometimes, a low carbon steel can be used to deter corrosion. Unfortunately, the use of low carbon steel is more expensive and, thus, is not necessarily economically feasible for use in heat exchangers 100. However, the present teachings of powder coating the heat exchange elements 140 in a manner as described herein overcomes the deficiencies of the prior art.

It should be appreciated by those skilled in the art that the heat exchange elements 140 may comprise various other geometrical shapes, such as circular, rectangular, pentagonal, hexagonal, etc., without departing from the scope of the present teachings. Therefore, it should be appreciated that the powder coating surface may be applied to heat exchange elements 140 having various cross-sectional shapes other than that illustrated in FIG. 2 without departing from the scope of the present teachings. Various configurations of heat exchange elements 140 and the manner in which they can be powder coated will be described in greater detail herein below.

FIGS. 3A-3E illustrate various embodiments of the heat exchange elements 140. It should be appreciated by those skilled in the art that the following embodiments of the heat exchange elements 140 comprise exemplary contours and configurations and are not meant to limit the scope of the present teachings.

Figure 3A:
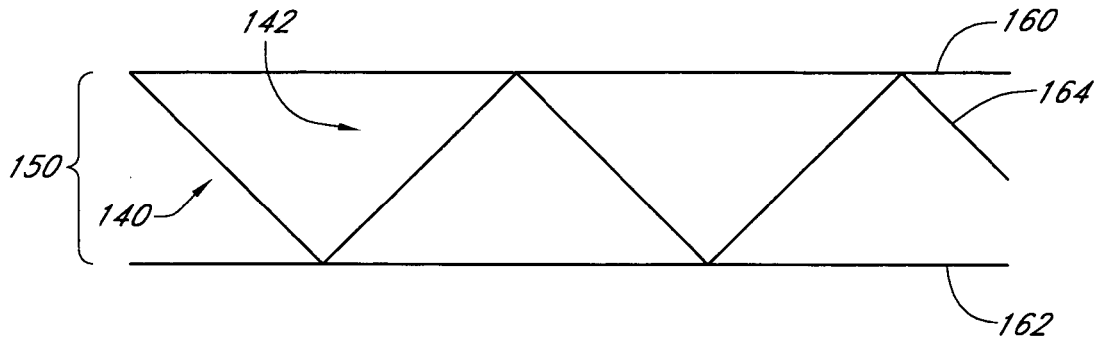
FIGS. 3A-3E illustrate some of the various possible configurations of the heat exchange elements.

FIG. 3A illustrate one embodiment of the heat exchange elements 140 described above in reference to FIG. 2. As illustrated in FIG. 3A, the elements 140 may comprise a section 150 having at least one corrugated layer 164 disposed adjacent to at least one flat layer 162. In one aspect, this illustrated contour or configuration of the elements 140 is formed so as to define a plurality of triangular shaped channels 142 through which air flows to thereby exchange heat with the elements 140. It should be appreciated that the combination of the corrugated layer 164 and the flat layer 162 may be repeated above and/or below the combination. For example, subsequent layering of additional sections 152 above and below the first section 140 can be used to form the core material 114 and at least partially fill the plurality of sectors 112 of the heat exchange rotor 102 as illustrated in FIGS. 1A-1B.

Figure 3B:
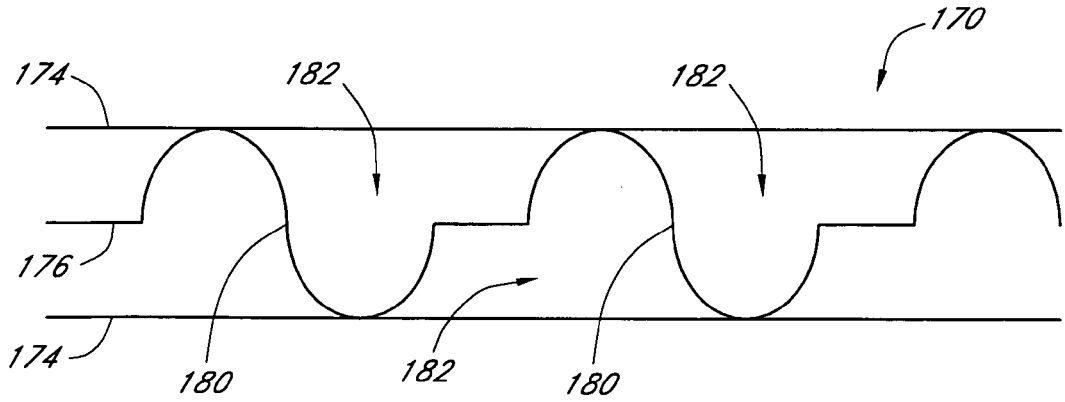

FIG. 3B illustrates another embodiment 170 of the heat exchange elements 140 comprising an undulation layer 176 disposed on a flat layer 174. As illustrated in FIG. 3B, the sectional shape of the undulation layer 176 comprises, a series of undulations 180 spaced at selected distances apart. In addition, each undulation 180 comprises an upper curved shape 184 joined to a lower curved shape 186 so as to define at least one cycle resembling a wave-like structure. Also, as further illustrated in FIG. 3B, two neighboring undulation sections 180 are separated by at least one flat section 188, wherein the undulation section 180 and the flat section 188 define a plurality of channels 182 through which air can flow. In one aspect, it should be appreciated that the combination of undulation and flat sections 180, 188 may be sequentially repeated. Alternatively, in another aspect, a serial combination of the flat section 174, undulation section 176, and another flat section 174 may be repeated as a group without departing from the scope of the present teachings.

In one embodiment, the undulation layers 176 may be arranged relative to each other such that the channels 182 defined by one layer extend along a direction that is different than a direction of the channels 182 of the other layer. Such angled configurations (sometimes referred to as a "cross" configuration) of the channels will be described in greater detail herein below in context of other possible channel contours, configurations, and shapes.

Figure 3C:
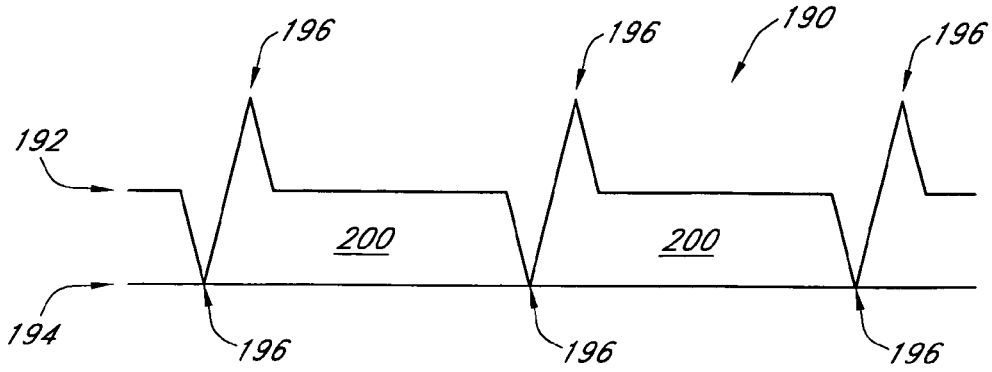

FIG. 3C illustrates still another embodiment 190 of the heat exchange elements 140 comprising a notched layer 192 disposed on a flat layer 194. As illustrated in FIG. 3C, the sectional shape of the notched layer 192 comprises a series of notches 196 spaced at selected distances apart. In addition, the notched layer 192 and the flat layer 194 define a plurality of channels 200 through which air can flow. It should be appreciated by those skilled in the art that the configuration of the heat exchange elements 140, as illustrated in FIG. 3C, may also be referred to as a notched flat (NF) configuration without departing from the scope of the present teachings.

It should also be appreciated by those skilled in the art that the various embodiments of the heat exchange elements 140 as previously described herein above comprise air flow channels that are generally aligned along a single direction. Therefore, it should also be appreciated that any number of different sectional shapes, contours, or configurations of the elements 140 may be used to achieve such an air flow and, in addition, may be implemented without departing from the scope of the present teachings. Moreover, the sectional shape of a given element 140 may depend on various factors, such as manufacturing techniques, structural requirements, air flow characteristics, heat exchange characteristics, etc.

Figure 3D:
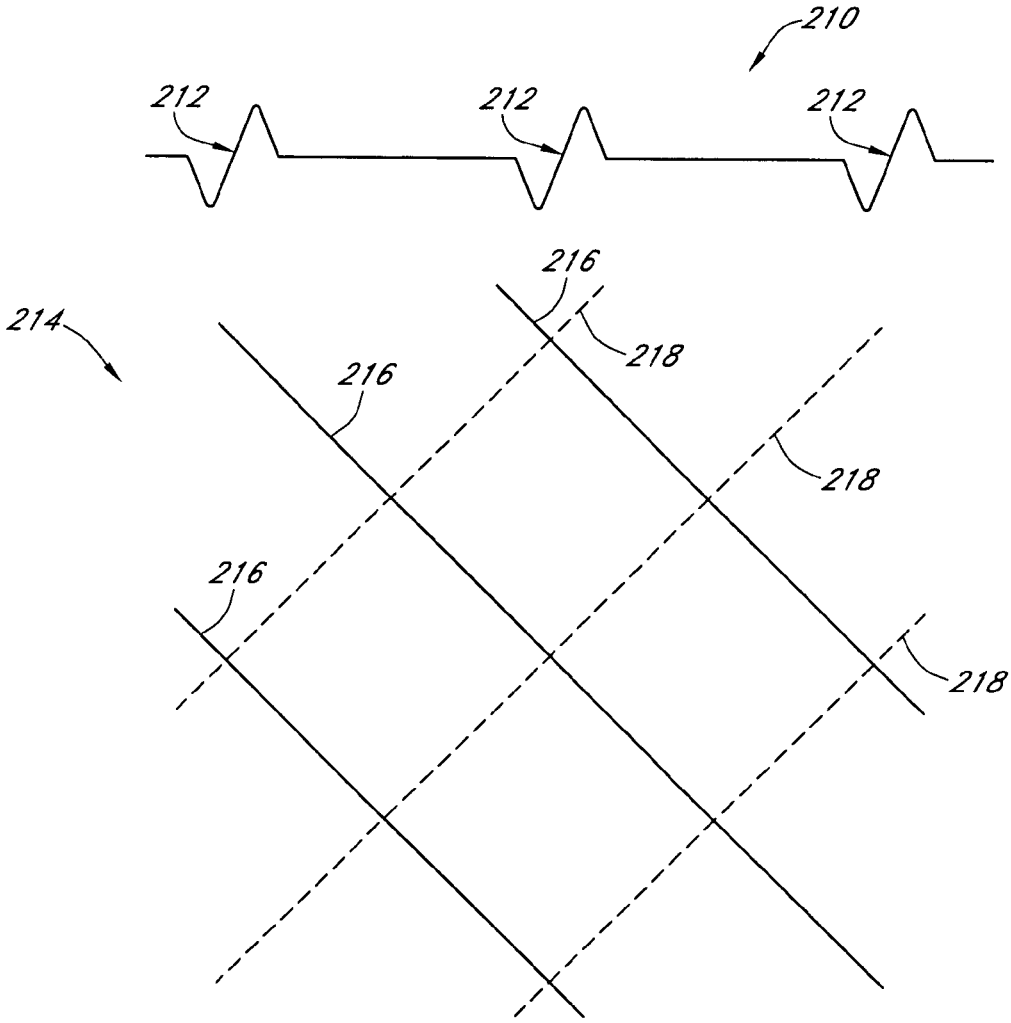

In other embodiments, the channels 142, 182 formed via the heat exchange elements 140 can be adapted to extend along various directions. For example, FIG. 3D illustrates one embodiment of the elements 140 comprising at least two notched layers 210 combined in a manner such that the channels of one layer extend at an angle with respect to channels of another layer. It should be appreciated by those skilled in the art that this configuration may be referred to as a notched crossed (NC) configuration. In one aspect, this angled channel direction relationship between the two layers is depicted in a plan view 214 as a plurality of solid lines 216 representing the notches 212 of one layer, and a plurality of dashed lines 218 representing the notches 212 of the other layer. The angle between the channel directions 216 and 218 may be selected to provide a suitable performance in terms of, by way of example, structural requirement and air flow characteristics.

Figure 3E:
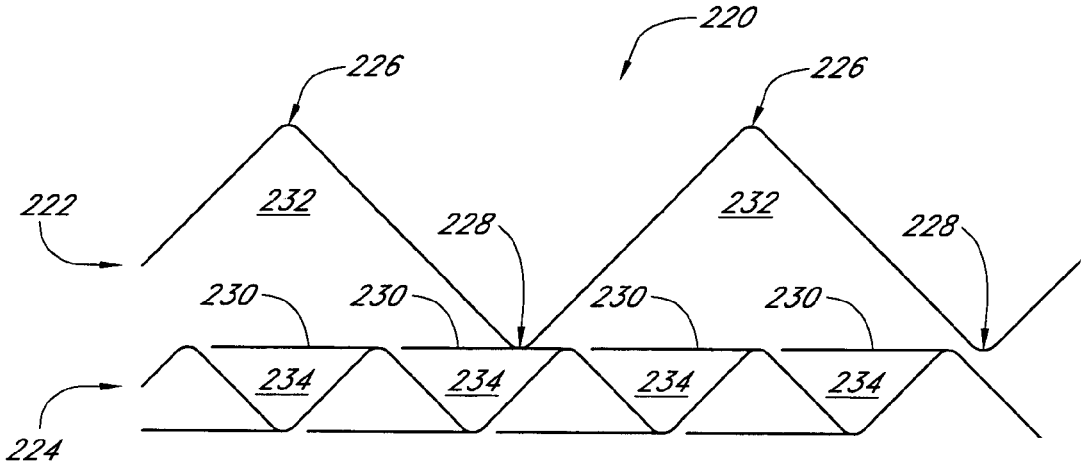
Figure 3E:
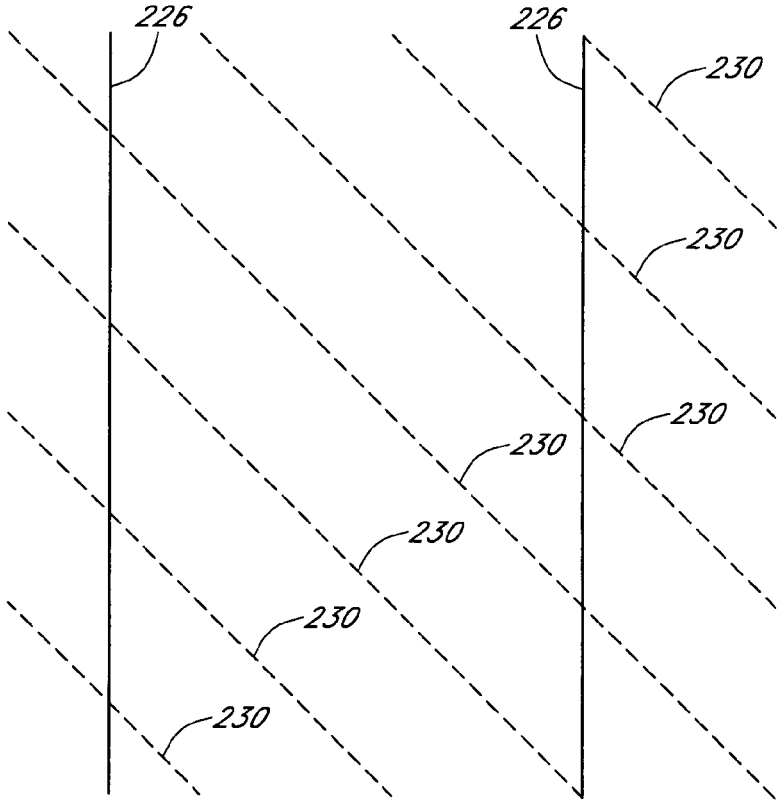

FIG. 3E illustrates one embodiment 220 of the heat exchange elements 140 having crossed channels. As illustrated in FIG. 3E, the elements 140 comprises a first corrugated layer 222 and a second corrugated layer 224. In one embodiment, the first corrugated layer 222 comprises a plurality of corrugations 226 that are larger than corrugations 230 defined by a second corrugated layer 224. The larger corrugations 226 define channels 232, and the smaller corrugations 230 define channels 234. The relative directions of the corrugations 226 and 230 are depicted in a plan view, wherein the larger corrugations 226 are represented as solid lines, and the smaller corrugations 230 are represented as dashed lines. When such two layers of corrugations are oriented in an angled manner, the channels 232 and 234 are cross coupled, which may be advantageous in certain applications. In general, it should be apparent that any number of channel shapes and sizes may be utilized in the elements 140. Moreover, relative channel directions between the adjacent layers may be selected in any number of ways without departing from the scope of the present teachings.

The various layers of the elements 140 described above may be formed in any number of ways known in the art. In one embodiment, the elements 140 may be formed out of metal such as low carbon steel or stainless steel. It should be appreciated by those skilled in the art that other forms of metals, as well as any other material, may be used to form the elements 140, wherein the material can be adapted to allow powder coating thereon. For the metal based elements, the layers may be formed out of sheet metal having various depending on the application or implementation. It should be appreciated by those skilled in the art that the sheet metal may comprise various thicknesses including but not limited to 18, 22, or 24 gauge sheet metal without departing from the scope of the present teachings.

Figure 4A:
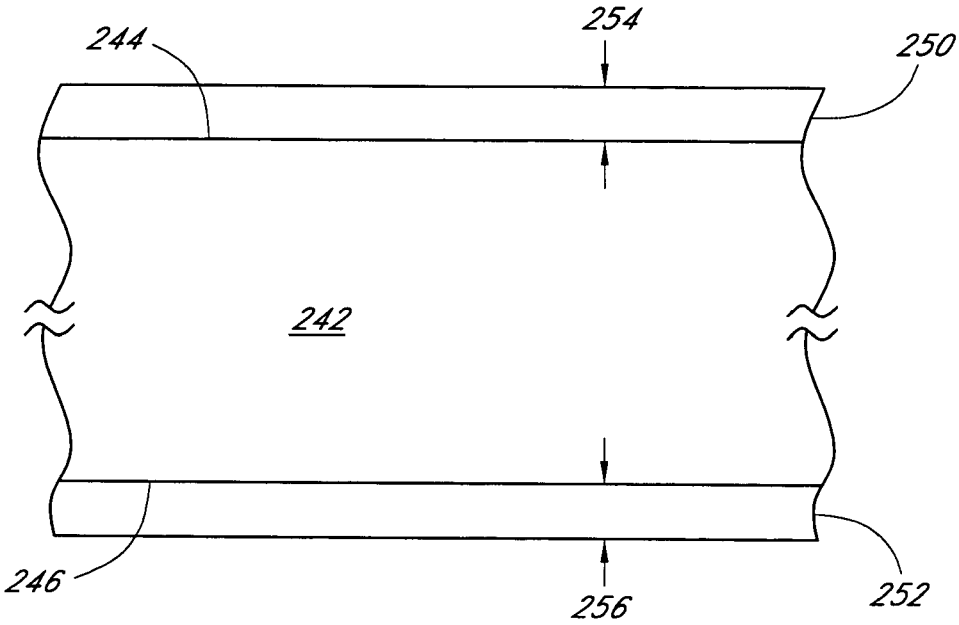
FIGS. 4A-4B illustrate powder coated surfaces of the heat exchange element.
Figure 4B:
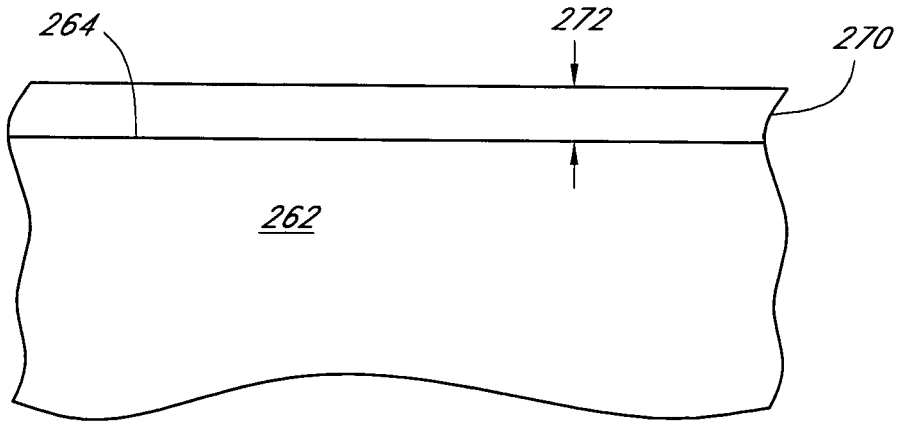

FIGS. 4A-4B illustrate a powder coating layer formed on a base material. In one embodiment, as illustrated in FIG. 4A, the base material comprises a base layer 242, such as any of the layers described herein. The base layer 242 defines a first surface 244 and a second surface 246, on which respective first and second powder coating layers 250, 252 are formed. Additionally, the first powder coating layer 250 has a first thickness 254, and the second powder coating layer 252 has a second thickness 256. It should be appreciated that, in various embodiments, the first and second thicknesses 254, 256 as well as the composition of the first and second powder coating layers 250, 252 may be similar.

FIG. 4B illustrates a base material 262 that does not have a layer-like structure. In one embodiment, parts of the elements 140 may have non-layer structural characteristics. In addition, a surface 264 defined by such base material 262 may also be powder coated so as to form a powder coating layer 270 having a thickness 272. In various embodiments, the powder coating layer 250, 252, 270 may be formed from powder coating particles so as to advantageously provide an operating temperature to approximately 975° F. Aside from the high operating temperature capability, the powder coating layer provides mechanical durability as well as improved chemical resistance to sulfur based compounds. In one aspect, the coating thickness is in the range of approximately 0.0015" to approximately 0.0025".

It should be appreciated by those skilled in the art that any number of powder coating materials may be used to form the powder coating layers for the elements without departing from the scope of the present teachings. Additionally, it should be appreciated that the type of powder coating particles and the thickness of the layer may vary depending on factors such as intended application and operating conditions of the heat exchanger 100.

Figure 5:
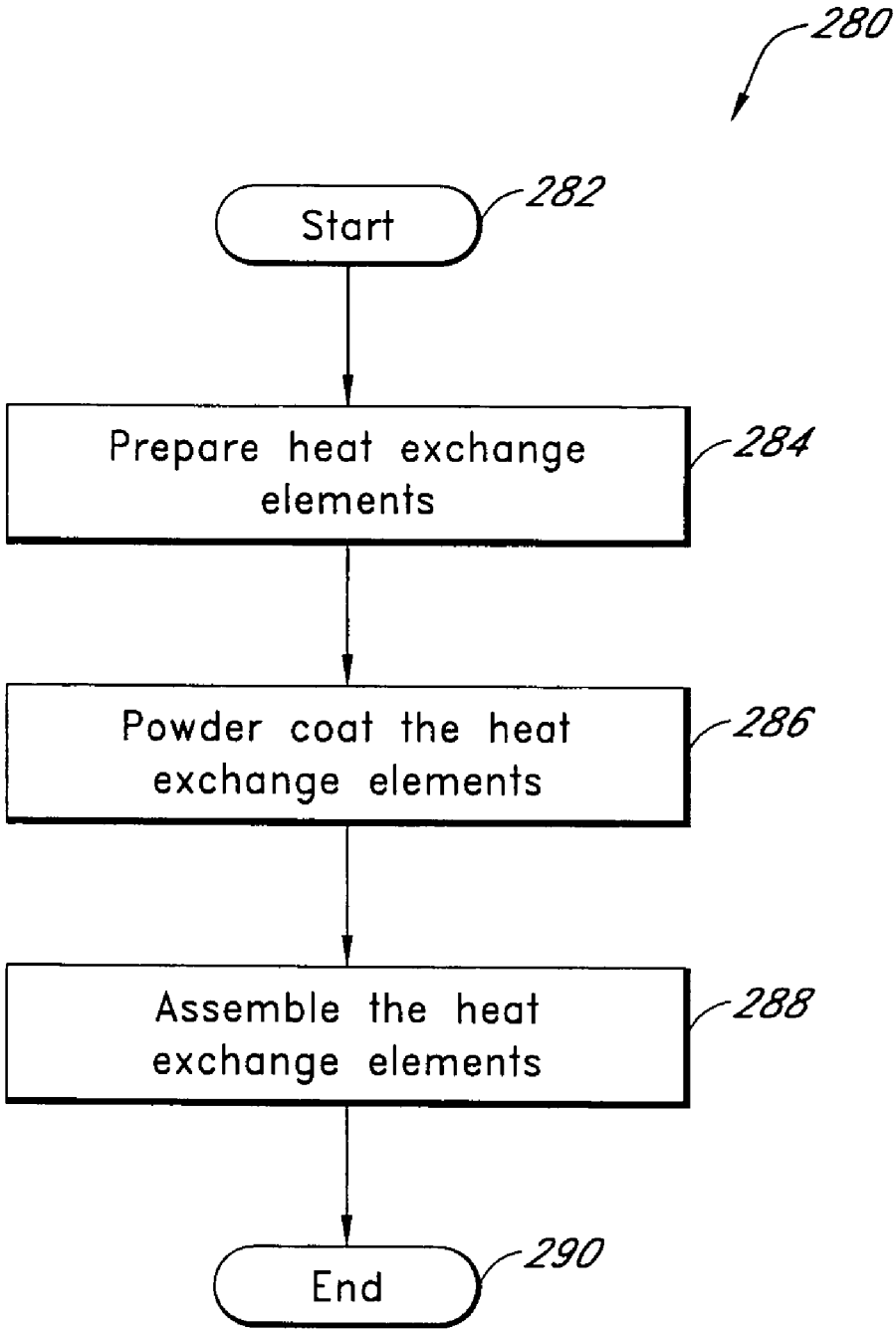
FIG. 5 illustrates one possible method of fabricating a heat exchanger having powder coated heat exchange elements.

FIG. 5 illustrates one embodiment of an overall process 280 for fabricating a heat exchanger having power coated elements 140. The process 280 begins at start state 282, and in a state 284 that follows, the heat exchanger elements 140 are prepared for assembly. Such preparation may include manufacturing or acquiring the elements or components of the elements 140. In state 286 that follows, the elements 140 or the components of the elements 140 are powder coated. The powder coating step will be described in greater detail herein below. Following, in a state 288, the elements 140 are assembled. The process 280 terminates in an end state 290.

Figure 6:
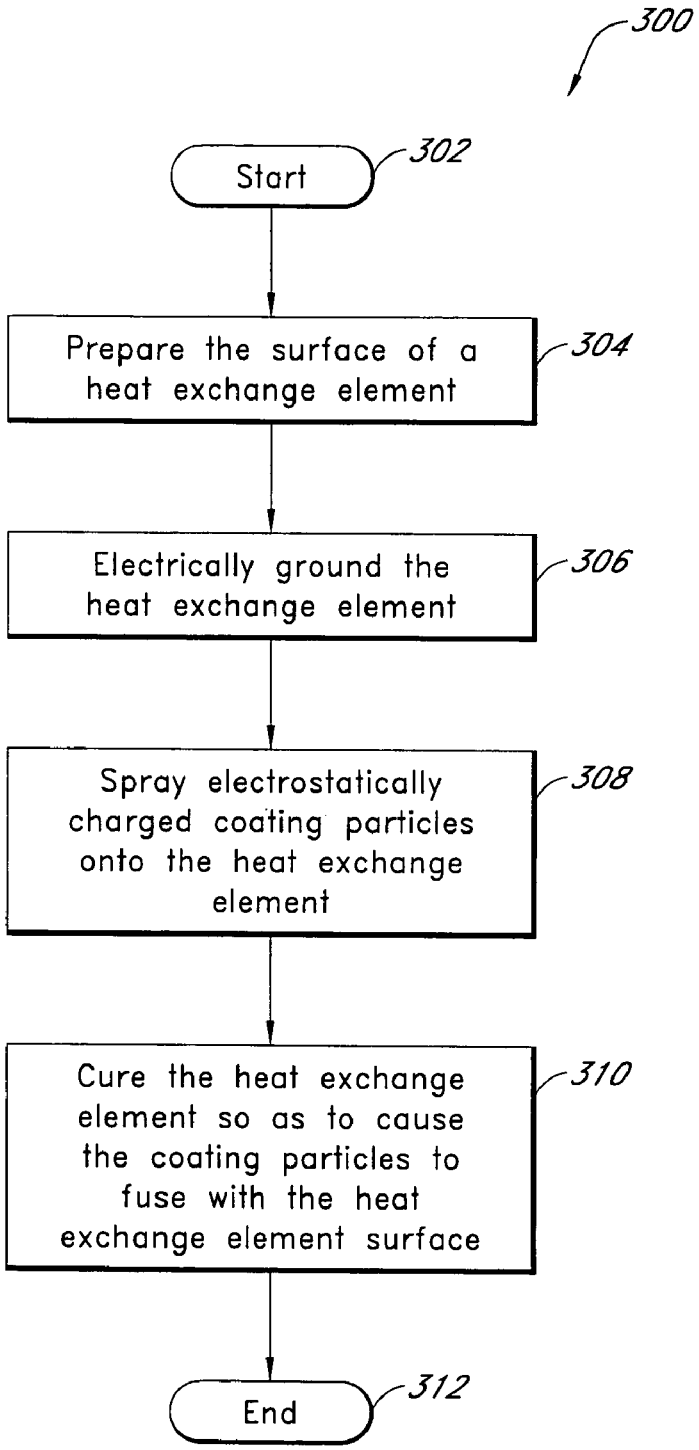
FIG. 6 illustrates one possible method of powder coating a heat exchange element.

FIG. 6 illustrates one embodiment of a process 300 for powder coating the heat exchange elements 140. It should be appreciated by those skilled in the art that such a process may occur in state 286 of the heat exchanger fabricating process 280 described above in reference to FIG. 5. In one aspect, the powder coating process 300 is performed on the components of the elements 140. Advantageously, powder coating may be applied to the separate layers of the elements 140 so as to improve the uniformity of powder application.

In one embodiment, the process 300 begins at start state 302, and in state 304 that follows, the surface of the element is prepared for powder coating. Such preparation may include cleaning and other pre-powder application processes that are generally known in the art. Proceeding to state 306 that follows, the prepared elements 140 are electrically connected to a selected electrical potential. In various implementations, such connection comprises electrical grounding of the elements 140. Next, in state 308, electrically charged coating particles are sprayed onto the elements 140. In one aspect, the elements 140 may be held at the selected electrical potential, which attracts the charged coating particles to the surface of the elements 140 and promotes adhesion thereto. Following, in state 310, the elements 140 with the applied coating particles is cured so as to cause the coating particles to substantially fuse with the surface of the elements 140 to thereby form a durable and resilient coating on the elements 140. Next, the process 300 terminates in an end state 312.

Advantageously, the Dupont based coating material, as previously described above with reference to FIGS. 4A-4B, may be used to achieve the approximate 975° F. operational temperature limit. In this embodiment, the curing process in state 310 comprises baking the coated components of the elements 140 for approximately one hour at a temperature of approximately 1200° F. It should be appreciated by those skilled in the art that the use of different coating materials may dictate different curing procedures.

In one embodiment, the heat exchange elements 140 and the heat exchangers 100 fabricated in the foregoing manner provides various advantages over conventional types of coatings. Traditionally, the heat exchange elements 140 are typically dipped in an enamel material to form an enamel coating. Unfortunately, this type of coating is susceptible to air pockets being trapped within the coating layer, which can adversely affect the durability and reliability of the coating layer. Additionally, the enamel coating is likely more susceptible to cracking when subjected to mechanical stresses. These mechanical stresses may arise, for example, during assembly of the heat exchanger when the elements are pressed together to form the segment, such as segment 130 in FIG. 2, which can also be referred to as a "basket". Moreover, additional mechanical stresses may be induced by thermal fluctuations and/or vibrations associated with the operation of the heat exchanger. Unfortunately, cracks and other breaches of the enamel coating exposes the underlying base layer to potentially corrosive materials. For example, if the heat exchanger is cleaned by a spray of water, the water can work its way into the metal and promote corrosion. The corrosive effects may be exacerbated if the air contains corrosive particulates, such as sulfur based compounds.

Figure 7:
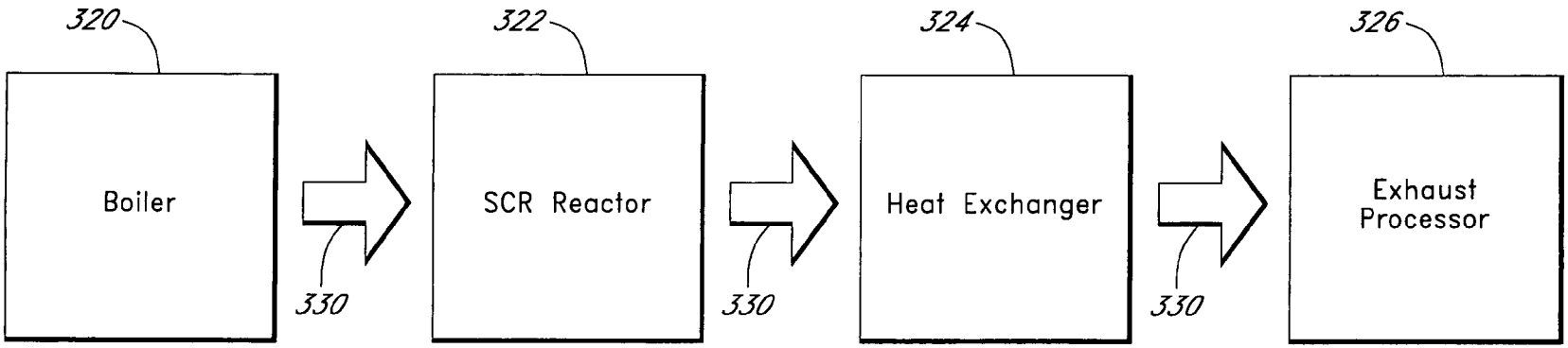
FIG. 7 illustrates one possible application of the heat exchanger having powder coated heat exchange elements, wherein the powder coating may be adapted to operate at high temperatures.

Advantageously, the powder coating of the heat exchange elements 140 of the present teachings as described herein above provide improved mechanical durability, resiliency, and performance to thereby provide improved corrosion resistance. FIG. 7 illustrates one possible application of the heat exchanger 100 having powder coated elements 140 in a harsh operating condition. For example, fossil fuel burning power generators typically comprise a boiler 320 that burns the fossil fuel to generate heat. As illustrated in FIG. 7, arrows 330 indicate the flow of a flue gas that results from the burning and is eventually ejected into the atmosphere. In some generators, the flue gas from the boiler 320 may pass through a selective catalytic reduction (SCR) reactor 322 to remove a substantial portion of $No_x$ present. The flue gas, whether from the boiler 320 or from the SCR reactor 322, then typically passes through a heat exchanger 324 to lower the gas temperature prior to being processed in an exhaust processor 326. It should be appreciated that the exhaust processor 326 may comprise an electrostatic precipitator that collects particulates from the gas and a smoke stack that ejects the gas to the environment.

As further illustrated in FIG. 7, the gas passing through the heat exchanger 324 may comprise a relatively high temperature and a relatively high concentration of particulates including sulfur based compounds. Therefore, the particulates may likely accumulate on the heat exchange elements 140, which may likely require routine cleanings. Because the powder coating on the elements 140 provides improved mechanical durability, resiliency, and performance in a manner described above, the corrosive effects are mitigated in an improved manner. Advantageously, the powder coating of the heat exchange elements 140 may withstand high operating temperatures with selected coating materials, such as the previously described Dupont based powder coating having a relatively large operational temperature limit. Therefore, the heat exchanger 100 having the powder coated heat exchange elements 140 of the present teachings are advantageously suited for high temperature and high sulfur environment applications, such as the fossil burning generators.

In some embodiments, powders used for coating preferably result in the coating having properties that are desirable for heat exchanger applications. These desirable properties include resiliency of the formed coating, high acid resistivity, and robust adherance to the underlying metal surface. Powders that result in such properties in the heat exchanger applications can include commercially available products such as those from Cardinal Industrial Finishes of City of Industry, California.

One such powder comprises an E305-GR533 epoxy powder coating formulation. The E305 has a specific gravity of approximately 1.56, with an average particle size of approximately 25-50 microns. The E305 powder coat can be cured by heating at approximately 400 degrees F. for approximately 10 minutes.

An exemplary E305 coat of approximately 2.0 to 4.5 mils thickness has a direct impact value of approximately 60 in-lbs using an industry D2794 method, and an indirect impact value of approximately 60 in-lbs using the same method. The exemplary coating has a pencil hardness in the "2H" category using the industry D3363 method.

The E305 has been designed to be applied by electrostatic spray on metals such as steel, galvanized steel, or aluminum, and the resulting coat has a good to excellent chemical resistance to most solvents, oils, acids, and alkalies. Advantageously, the E305 powder can be reclaimed, sieved, and recycled.

Another powder available from Cardinal comprises a P004-GR16 polyester polyurethane powder coating formulation. The intended application, recyclability, chemical resistance property, and pencil hardness are similar to that of the E305 formulation. The P004 powder coat (of an exemplary coating thickness of approximately 1.5 to 3.0 mils) has direct and indirect impact values of approximately 120 in-lbs. Such a coating can be achieved by heating the powder coat for approximately 12 minutes at approximately 400 degrees F.

Another powder available from Cardinal comprises a H305-GR10 epoxy polyester hybrid powder coating formulation. The intended application, recyclability, chemical resistance property, impact values and pencil hardness are similar to that of the P004 formulation. In addition to the chemical resistance property, the H305 coating provides an excellent resistance against salt spray and humidity. Using the industry ASTM B117 method, the H305 coating exhibits approximately 1,000 hours of salt spray with less than approximately ⅛ inch creep from a scribe. Using the industry ASTM D2247 method, the H305 coating exhibits approximately 1,000 hours of humidity exposure with substantially no loss of adhesion or blistering. Such a coating can be achieved by heating the powder coat for approximately 10 minutes at approximately 400 degrees F.

Although the above-disclosed embodiments of the present teachings have shown, described, and pointed out the fundamental novel features of the invention as applied to the above-disclosed embodiments, it should be understood that various omissions, substitutions, and changes in the form of the detail of the devices, systems, and/or methods illustrated may be made by those skilled in the art without departing from the scope of the present teachings. Consequently, the scope of the invention should not be limited to the foregoing description, but should be defined by the appended claims.

What is claimed is:

1. A heat exchanger comprising:

a heat exchanging body rotatable relative to a housing; and a plurality of heat exchange elements disposed in the heat exchanging body so as to define a plurality of channels that allow air to flow therethrough, wherein each heat exchange element includes a resilient and mechanically durable powder coating with an operational temperature limit of approximately 975° F. and consisting of dry powder particles configured to cure at a temperature above ambient to provide a protective layer configured to inhibit corrosion inducing agents formed in a selective catalytic reduction process during operation of a fossil fuel burning power plant from contacting an underlying surface of the heat exchange element to thereby resist corrosion of the heat exchange element, wherein the thickness of the powder coating on the heat exchange elements is between 1.5-2.5 mils, said thickness configured to inhibit said corrosion inducing agents from contacting said underlying surface of the heat exchange elements to thereby resist corrosion of the heat exchange elements, while not inhibiting heat transfer between the heat exchange elements and said airflow.

2. The heat exchanger of claim 1, wherein the heat exchanging body comprises a rotor, wherein the rotor is adapted to rotate about a rotational axis with respect to the housing such that a given portion of the rotor gains heat energy at a first location and gives off heat energy at a second location.

3. The heat exchanger of claim 2, wherein the heat exchanger further comprises a first air passage assembly disposed adjacent the heat exchanging body, and wherein the air passage assembly is adapted to allow air to flow through a portion of the heat exchange body.

4. The heat exchanger of claim 3, wherein the first air passage assembly is disposed adjacent the rotor at one of the first or second locations.

5. The heat exchanger of claim 3, wherein the air passage assembly is adapted to allow flow of air through a portion of the heat exchange body along a first direction relative to the rotational axis.

6. The heat exchanger of claim 5, wherein the first direction is substantially parallel to the rotational axis.

7. The heat exchanger of claim 1, wherein the heat exchanging body is divided into a plurality of sectors, and wherein each sector includes at least one heat exchange element positioned therein.

8. The heat exchanger of claim 1, wherein the powder coating comprises a high silica content.

9. The heat exchanger of claim 1, wherein the powder coating is configured to withstand approximately 1000° F. for approximately 24 hours.

10. The heat exchanger of claim 1, wherein the heat exchanger is configured to reduce the temperature of a flue gas emitted from the fossil fuel burning power plant prior to the ejection of said flue gas into the environment.

11. A heat exchanger comprising:

a heat exchanging body that rotates with respect to a housing;

a first air passage assembly disposed adjacent the heat exchanging body, wherein the air passage assembly is adapted to allow flow of air through a portion of the heat exchange body; and a plurality of heat exchange elements disposed in the heat exchanging body, wherein each heat exchange element defines a heat exchanging surface adapted to facilitate the heat exchange with the air flowing through the heat exchanging body, and wherein the heat exchanging surface includes a resilient and mechanically durable powder coating with an operational temperature limit of approximately 975° F. and consisting of dry powder particles configured to cure at a temperature above ambient to provide a protective layer configured to inhibit corrosion inducing agents formed in a selective catalytic reduction process during operation of a fossil fuel burning power plant from contacting an underlying surface of the heat exchange element to resist corrosion thereof, wherein the thickness of the powder coating on the heat exchange elements is between 1.5-2.5 mils, said thickness configured to inhibit said corrosion inducing agents from contacting said underlying surface of the heat exchange elements to thereby resist corrosion of the heat exchange elements, while not inhibiting heat transfer between the heat exchange elements and said airflow.

12. The heat exchanger of claim 11, wherein the heat exchanging body comprises a rotor, wherein the rotor is adapted to rotate about a rotational axis with respect to the housing such that a given portion of the rotor gains heat energy at a first location and gives off heat energy at a second location.

13. The heat exchanger of claim 12, wherein the first air passage assembly is disposed adjacent the rotor at one of the first or second locations.

14. The heat exchanger of claim 12, wherein the air passage assembly is adapted to allow flow of air through a portion of the heat exchange body along a first direction relative to the rotational axis.

15. The heat exchanger of claim 14, wherein the first direction is substantially parallel to the rotational axis.

16. The heat exchanger of claim 11, wherein the heat exchanging body defines a plurality of segments, and wherein each segment defines a volume dimensioned to receive a plurality of heat exchange elements, and wherein each segment extends from a first angle to a second angle so as to generally resemble a pie-slice shape when viewed along the rotational axis.

17. The heat exchanger of claim 11, wherein the heat exchange elements comprise shaped sheets of material dimensioned so as to be stackable along a radial direction, and wherein the shaped sheets are oriented so as to allow flow of air with a net direction that is generally parallel to the rotational axis.

18. The heat exchanger of claim 17, wherein the shaped sheets comprise a material selected from the group consisting of a sheet of metal, a sheet of stainless steel, a sheet of low carbon steel.

19. The heat exchanger of claim 17, wherein the thickness of the shaped sheet is between approximately 18-24 gauge.

20. The heat exchanger of claim 17, wherein the shaped sheets define a plurality of channels for the flow of air such that, when stacked, the channels extend in a direction substantially parallel to the rotational axis.

21. The heat exchanger of claim 17, wherein the shaped sheets comprises a first type of sheet and a second type of sheet such that the first type of sheet defines a plurality of channels that extend along a first direction relative to the rotational axis and the second type of sheet defines a plurality of channels that extend along a second direction relative to the rotational axis.

22. The heat exchanger of claim 21, wherein the channels of the first type of sheet and the channels of the second type of sheet faun crossing patterns.

23. The heat exchanger of claim 11, wherein the heat exchanger is configured to reduce the temperature of a flue gas emitted from the fossil fuel burning power plant prior to the ejection of said flue gas into the environment.

24. A heat exchange assembly for a heat exchanger having a heat exchanging body that rotates in a first direction with respect to a housing, the assembly comprising:

a plurality of heat exchange members that are formed so as define a heat exchange surface, wherein the heat exchange members are positioned in the heat exchanging body to thereby facilitate heat exchange with a flow of air; and a protective layer disposed on the heat exchange surface, wherein the protective layer comprises a resilient and mechanically durable powder coating with an operational temperature limit of approximately 975° F. and consisting of dry powder particles configured to cure at a temperature above ambient to provide the protective layer configured to inhibit corrosion inducing agents formed in a selective catalytic reduction process during operation of a fossil fuel burning power plant from contacting an underlying surface of the heat exchange members to inhibit corrosion of the heat exchange members, wherein the thickness of the powder coating on the heat exchange surface is between approximately 1.5-2.5 mils, said thickness configured to inhibit said corrosion inducing agents from contacting said underlying surface of the heat exchange members to thereby resist corrosion of the heat exchange members, while not inhibiting heat transfer between the heat exchange members and said airflow.

25. The assembly of claim 24, wherein the powder coating comprises a high silica content.

26. The assembly of claim 24, wherein the powder coating is configured to withstand approximately 1000° F. for approximately 24 hours.

27. The assembly of claim 24, wherein the heat exchange members comprise a low carbon steel.

28. The assembly of claim 24, wherein the thickness of the heat exchange members is between approximately 18-24 gauge.

29. The assembly of claim 24, wherein the heat exchange members are formed so as to define a plurality of channels to allow air to flow along the channels so as to facilitate heat exchange with the air.

30. The assembly of claim 24, wherein the heat exchange members comprise a cross sectional shape including a plurality or undulations separated by a flat section, and wherein each undulated shape comprises an upper curved shape joined to a lower curved shape so as to form a full cycle wave like structure.

31. The assembly of claim 24, wherein the heat exchange members comprises a corrugated configuration.

32. The assembly of claim 24, wherein the heat exchange members comprise a notched flat configuration.

33. The assembly of claim 24, wherein the powder coating provides a barrier for the underlying heat exchange members to thereby resist corrosion inducing agents including water and sulfur based compounds.

34. The assembly of claim 24, wherein the powder coating protective layer has a hardness value greater than a selected level and a high resilience in an acidic environment.

35. The assembly of claim 34, wherein the selected value level of hardness value is approximately 2H in a ASTM Method D3363 pencil hardness standard.

36. The heat exchanger of claim 1, wherein the corrosion inducing agents comprise sulfur based compounds.

37. The heat exchanger of claim 11, wherein the corrosion inducing agents comprise sulfur based compounds.

38. The assembly of claim 24, wherein the corrosion inducing agents comprise sulfur based compounds.

39. The heat exchanger of claim 1, wherein the powder coating is a polyester based powder coating.

40. The heat exchanger of claim 11, wherein the powder coating is a polyester based powder coating.

41. The heat exchanger of claim 24, wherein the powder coating is a polyester based powder coating.

* * * * *